US010182288B2

(12) United States Patent
Kim

(10) Patent No.: US 10,182,288 B2
(45) Date of Patent: Jan. 15, 2019

(54) MICROPHONE

(71) Applicant: KOREA UNIVERSITY OF TECHNOLOGY AND EDUCATION INDUSTRY-UNIVERSITY COOPERATION FOUNDATION, Cheonan-si, Chungcheongnam-do (KR)

(72) Inventor: Byungki Kim, Cheonan-si (KR)

(73) Assignee: KOREA UNIVERSITY OF TECHNOLOGY AND EDUCATION INDUSTRY-UNIVERSITY COOPERATION FOUNDATION, Cheonan-si, Chungcheongnam-do (KR)

( * ) Notice: Subject to any disclaimer, the term of this patent is extended or adjusted under 35 U.S.C. 154(b) by 0 days.

(21) Appl. No.: 15/541,473

(22) PCT Filed: Jan. 8, 2016

(86) PCT No.: PCT/KR2016/000189

§ 371 (c)(1),
(2) Date: Jul. 4, 2017

(87) PCT Pub. No.: WO2016/111583

PCT Pub. Date: Jul. 14, 2016

(65) Prior Publication Data

US 2018/0027325 A1 Jan. 25, 2018

(30) Foreign Application Priority Data

Jan. 8, 2015 (KR) ..... 10-2015-0002931
Jan. 8, 2015 (KR) ..... 10-2015-0002938
Feb. 10, 2015 (KR) ..... 10-2015-0019921

(51) Int. Cl.
*H04R 1/40* (2006.01)
*H04R 1/08* (2006.01)
(Continued)

(52) U.S. Cl.
CPC ..... *H04R 1/406* (2013.01); *H04R 1/086* (2013.01); *H04R 1/083* (2013.01); *H04R 7/04* (2013.01);
(Continued)

(58) Field of Classification Search
None
See application file for complete search history.

(56) References Cited

U.S. PATENT DOCUMENTS 5,853,005 A 12/1998 Scanlon
7,535,620 B2 * 5/2009 Zhou ..... G02B 26/0841 359/290
(Continued)

FOREIGN PATENT DOCUMENTS

KR 10-1998-0041111 A 8/1998
KR 10-2010-0119323 A 11/2010
(Continued)

OTHER PUBLICATIONS

International Search Report for PCT/KR2016/000189 dated Apr. 18, 2016 from Korean Intellectual Property Office.

*Primary Examiner* — Curtis Kuntz
*Assistant Examiner* — Qin Zhu
(74) *Attorney, Agent, or Firm* — Revolution IP, PLLC

(57) ABSTRACT

A microphone comprises: a vibration member having a plate shape and formed so as to have elasticity and cause bending due to sound waves; a case having a depressed groove, which forms an air layer between the depressed groove and the vibration member since the vibration member is stacked on an upper part thereof, and coupled to the upper part of the depressed groove such that the vibration member is vibrated by sound waves; and a vibration detection unit provided on the vibration unit and the case and measuring the vibration of the vibration member vibrating by sound waves on the
(Continued)

case, wherein when the vibration member vibrates, the air in the air layer flows so as to damp the vibration of the vibration member.

12 Claims, 12 Drawing Sheets

(51) Int. Cl.
*H04R 31/00* (2006.01)
*H04R 29/00* (2006.01)
*H04R 19/04* (2006.01)
*H04R 7/04* (2006.01)

(52) U.S. Cl.
CPC ..... *H04R 19/04* (2013.01); *H04R 29/004* (2013.01); *H04R 31/00* (2013.01); *H04R 2201/003* (2013.01); *H04R 2201/405* (2013.01); *H04R 2440/03* (2013.01)

(56) References Cited

U.S. PATENT DOCUMENTS

2002/0146200 A1* 10/2002 Kudrle ..... B81B 3/0062 385/18
2009/0185250 A1* 7/2009 Turner ..... G02B 26/0833 359/199.1
2009/0320597 A1* 12/2009 Hattori ..... G01P 15/123 73/514.36
2009/0322260 A1* 12/2009 Lee ..... B81B 3/0021 318/116
2011/0211725 A1* 9/2011 Takewa ..... H04R 7/04 381/413
2013/0236037 A1* 9/2013 Weigold ..... H04R 1/406 381/174
2014/0313861 A1 10/2014 Torashima et al.
2015/0156575 A1* 6/2015 Kim ..... H04R 17/02 381/355
2015/0162523 A1* 6/2015 Umeda ..... H01L 41/0478 310/331
2016/0142829 A1* 5/2016 Berger ..... H04R 23/00 381/174
2016/0212542 A1* 7/2016 Wang ..... H04R 19/005
2016/0264398 A1* 9/2016 Bharatan ..... B81B 3/007

FOREIGN PATENT DOCUMENTS

KR 10-2014-0125301 A 10/2014
KR 10-1478970 B1 1/2015

* cited by examiner

[Fig. 1]
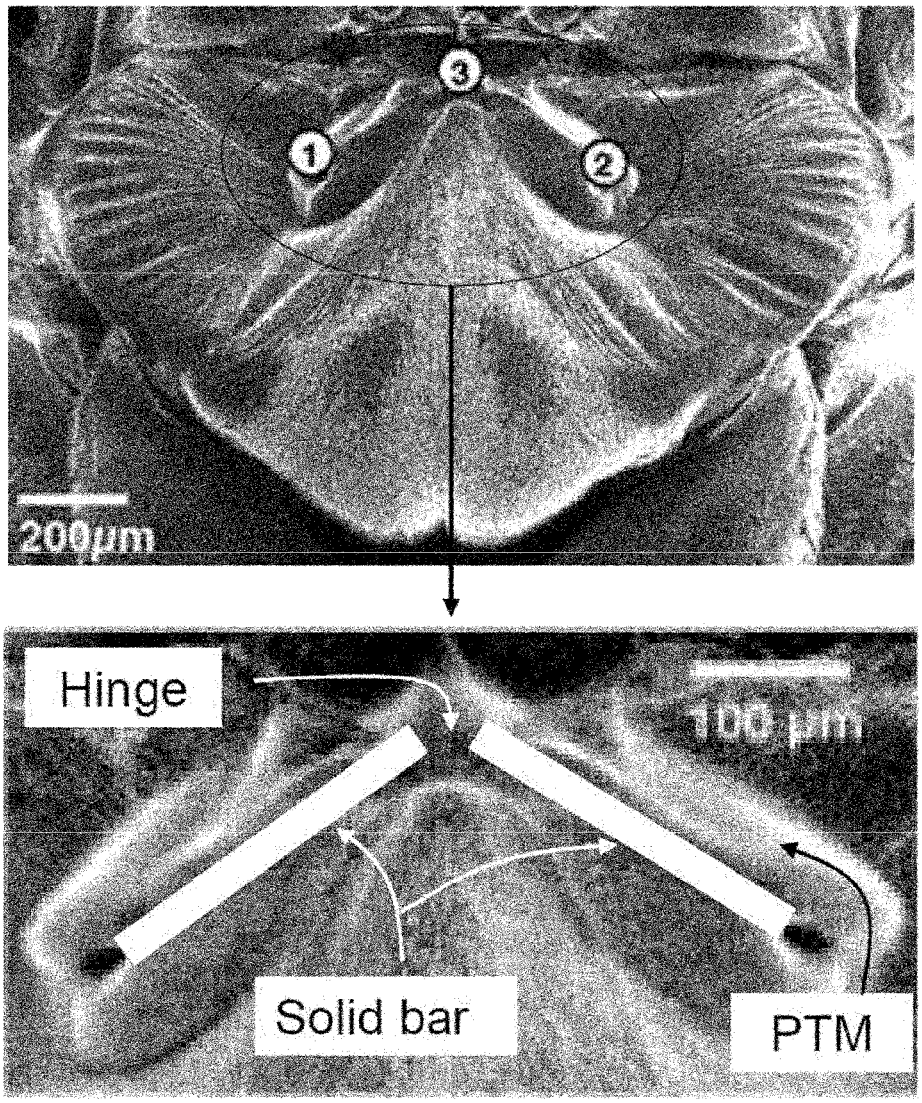

[Fig. 2]
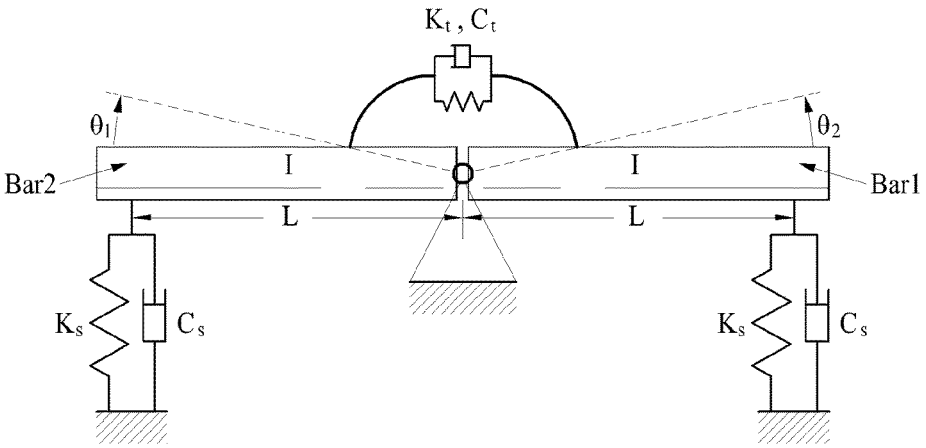
[Fig. 3]
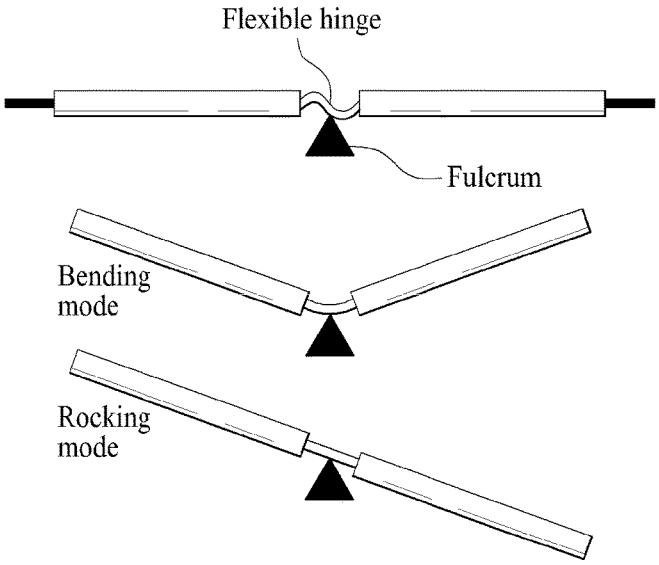

[Fig. 4]
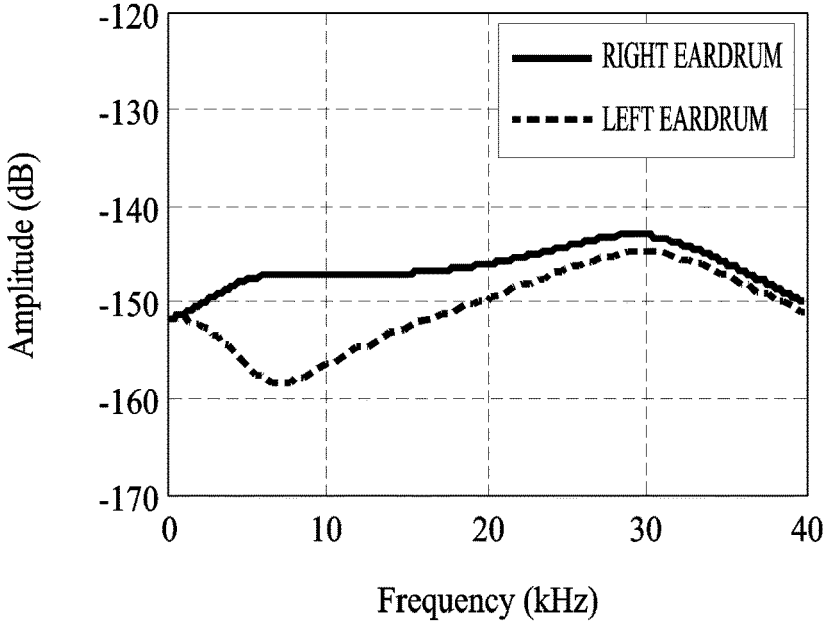
[Fig. 5]
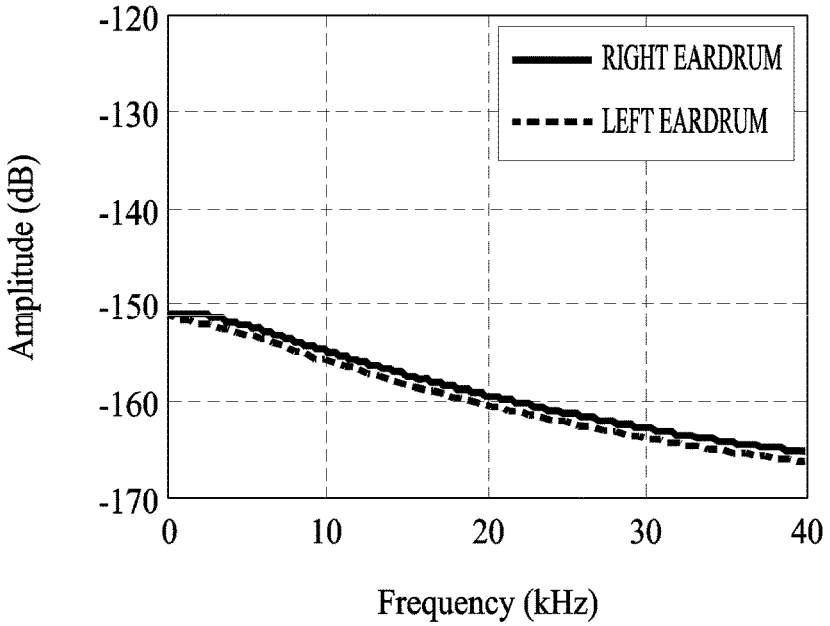

[Fig. 6]
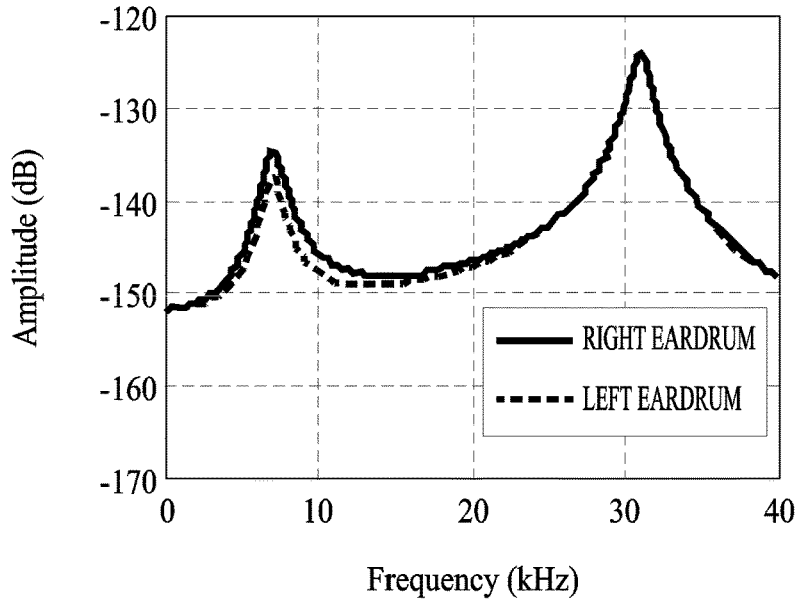
[Fig. 7]
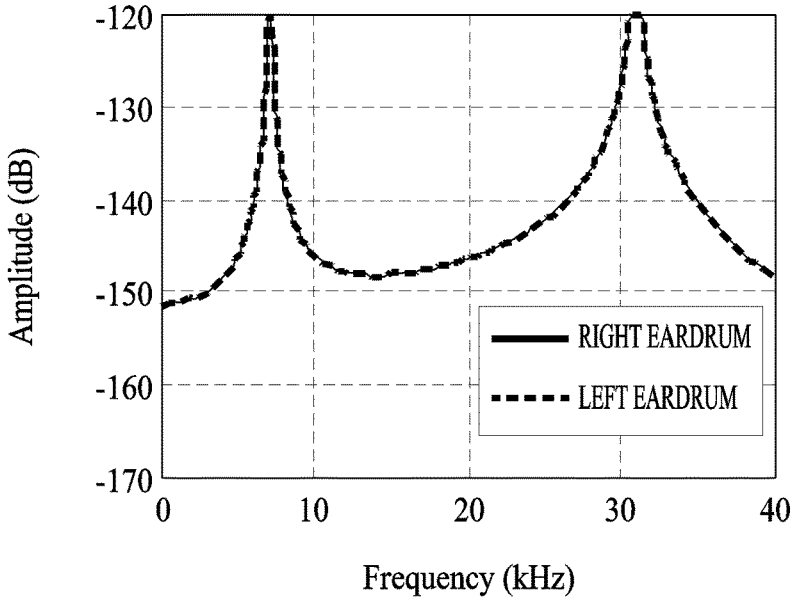

[Fig. 8]
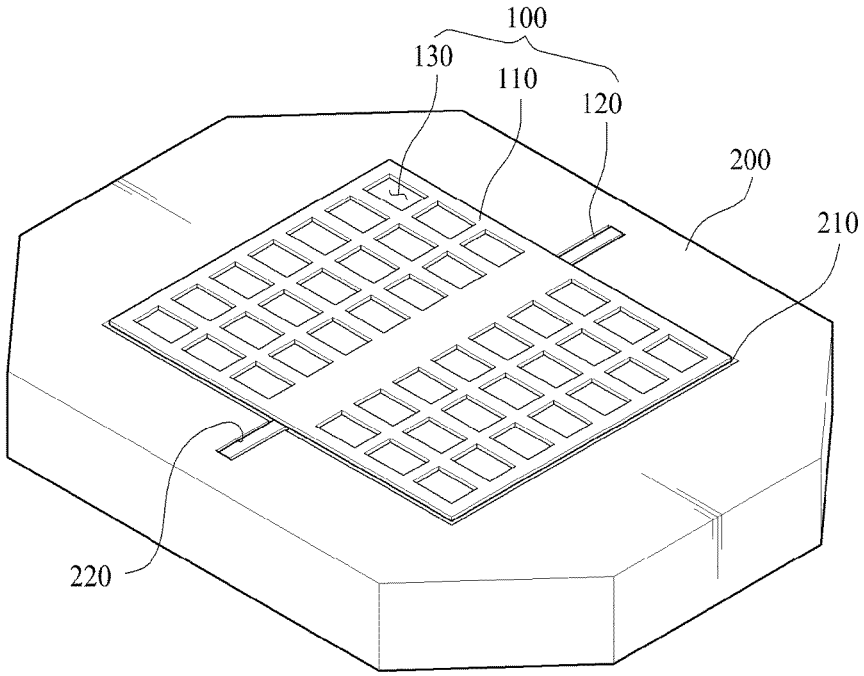
[Fig. 9]
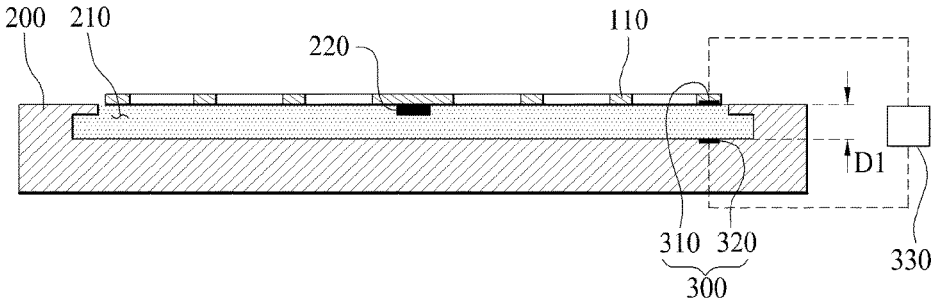

[Fig. 10]
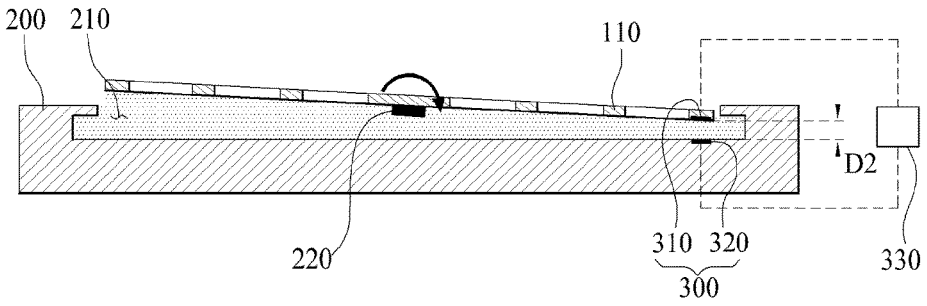
[Fig. 11]
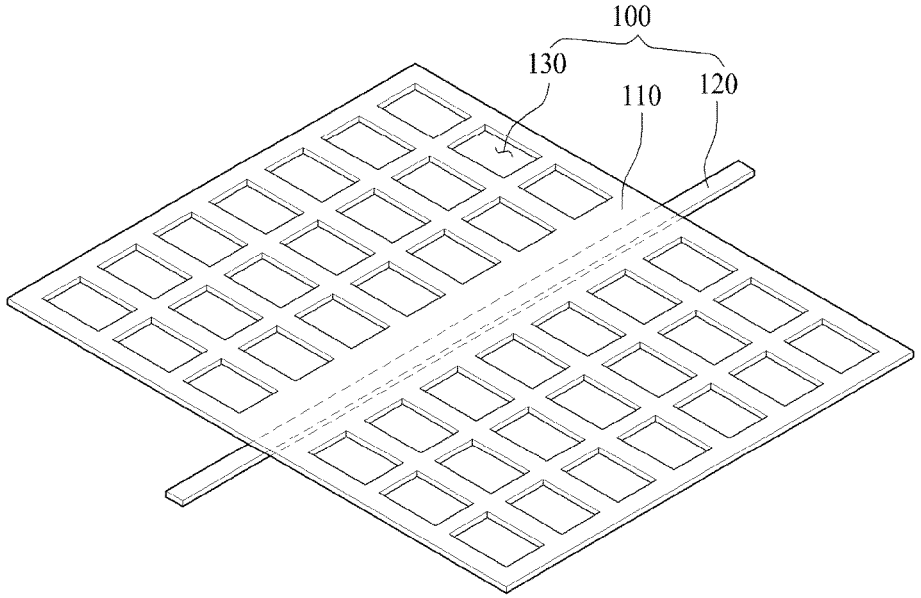

[Fig. 12]
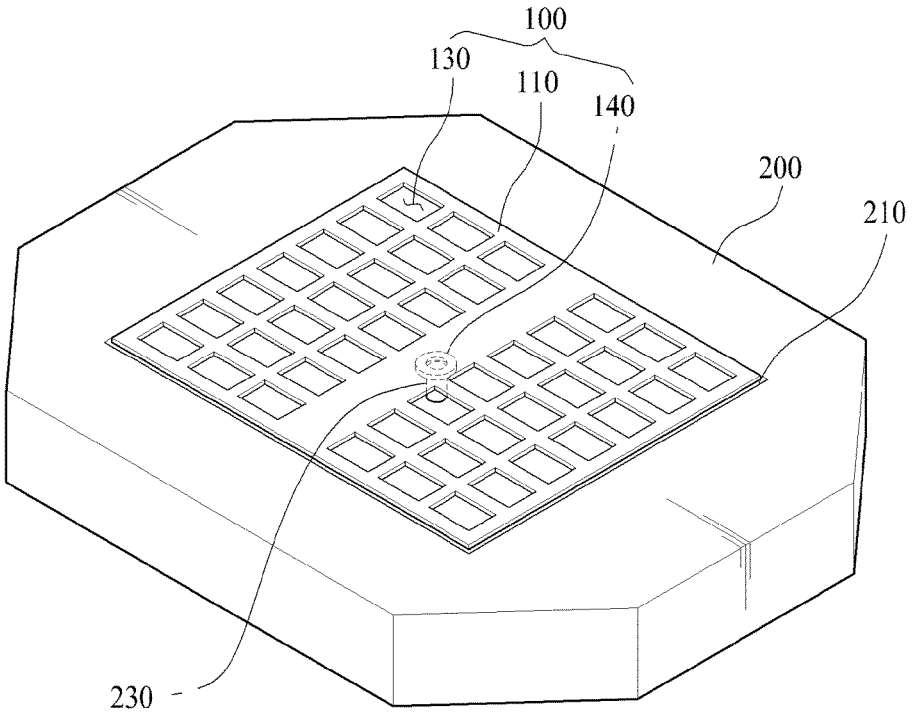
[Fig. 13]
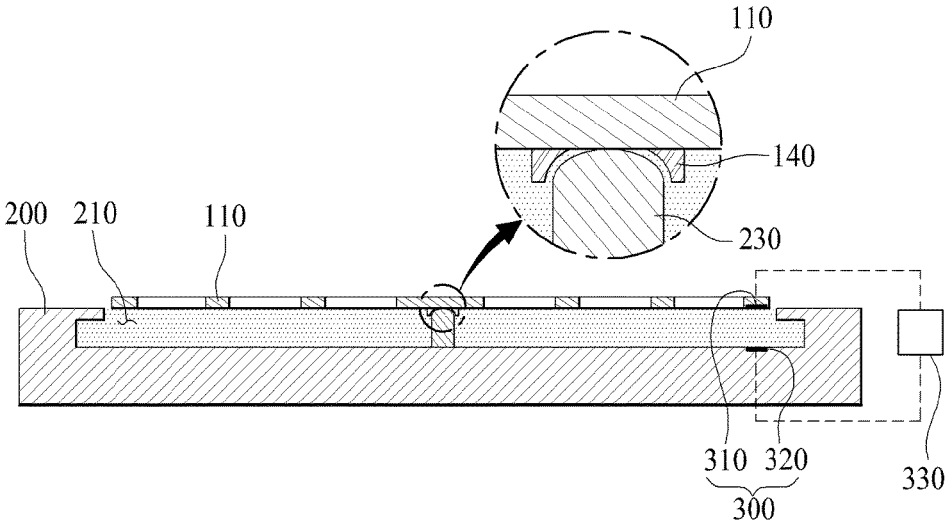

[Fig. 14]
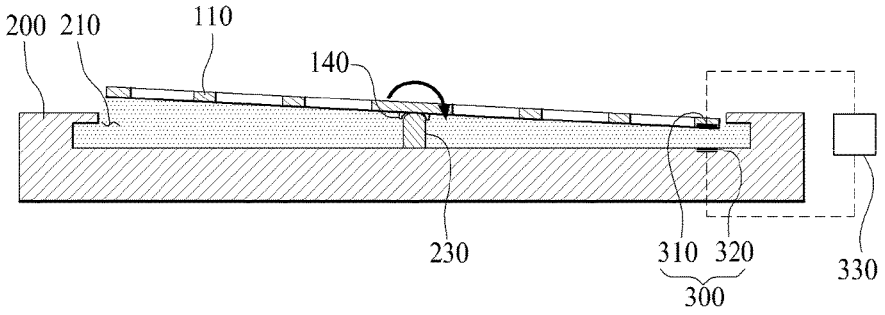
[Fig. 15]
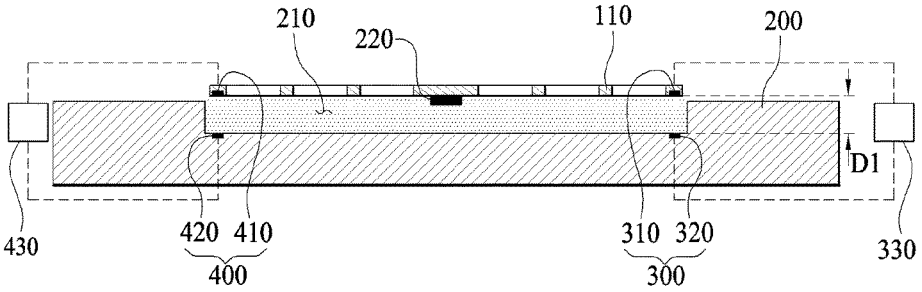
[Fig. 16]
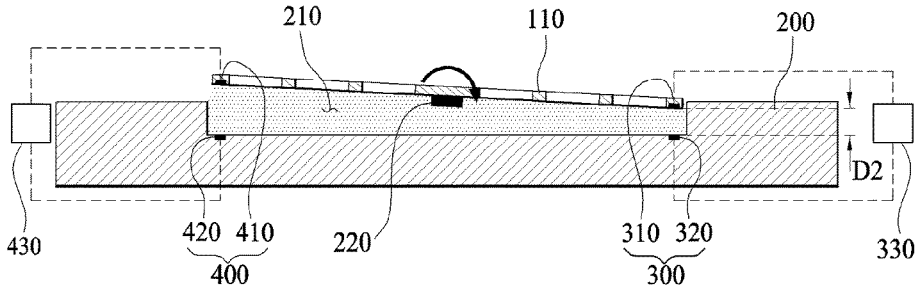

[Fig. 17]
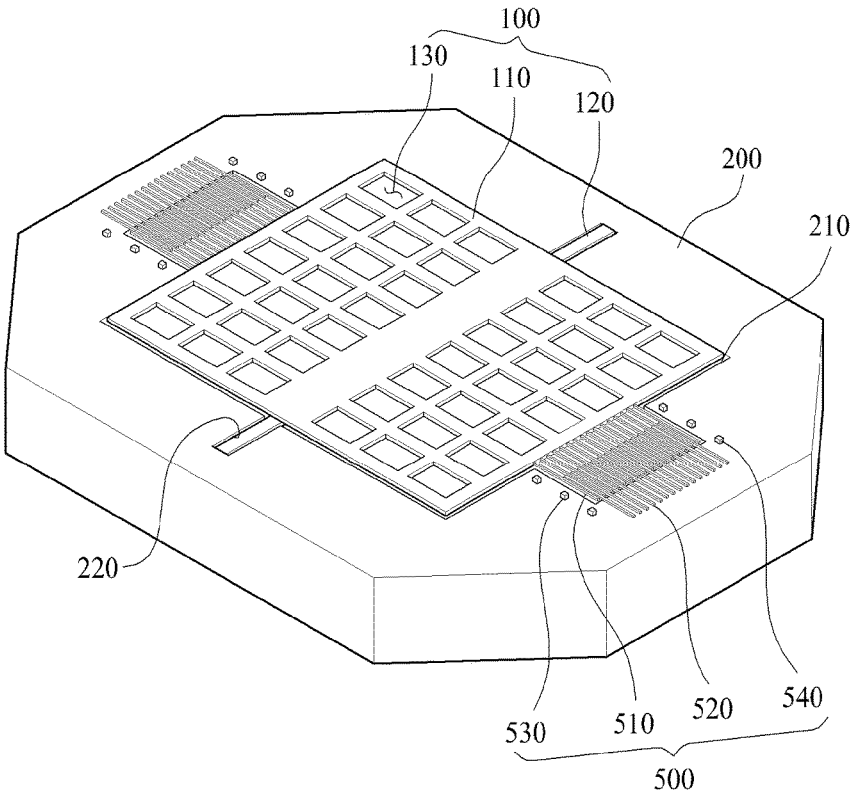
[Fig. 18]
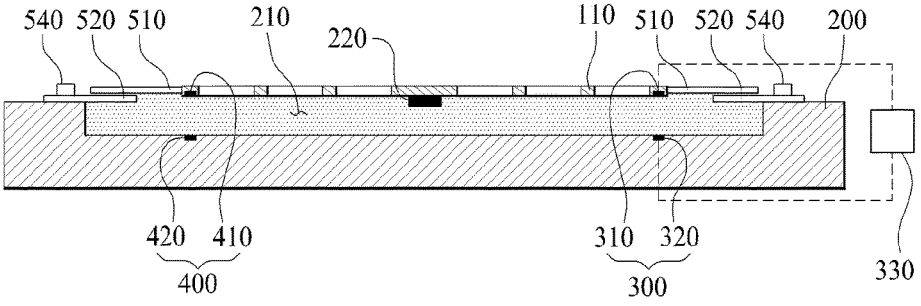

[Fig. 19]
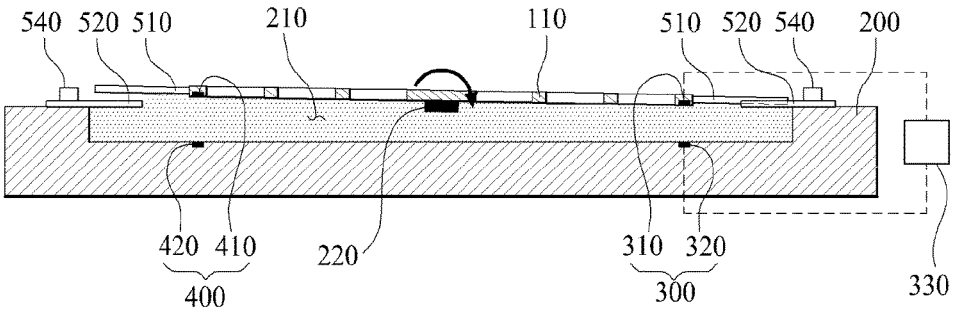
[Fig. 20]
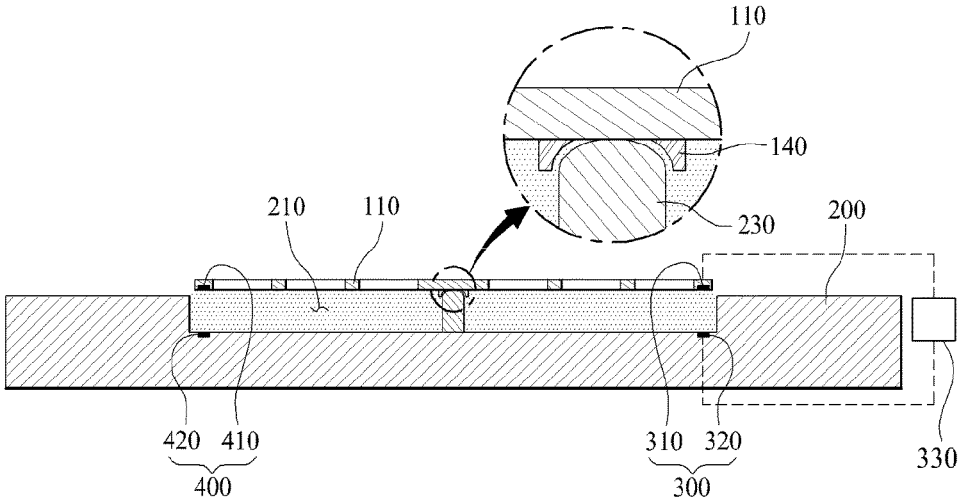

[Fig. 21]
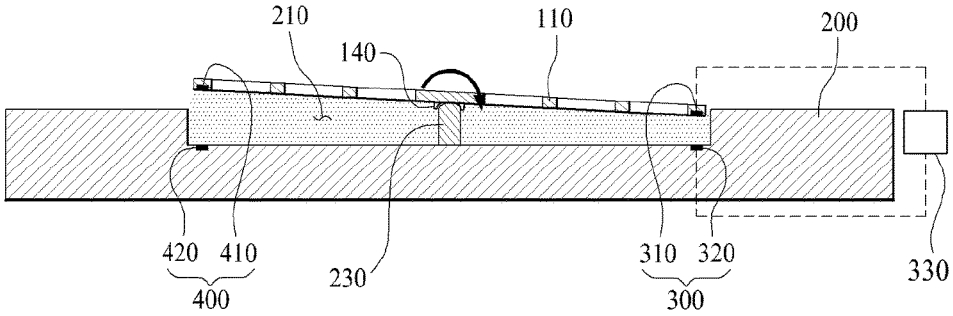
[Fig. 22]
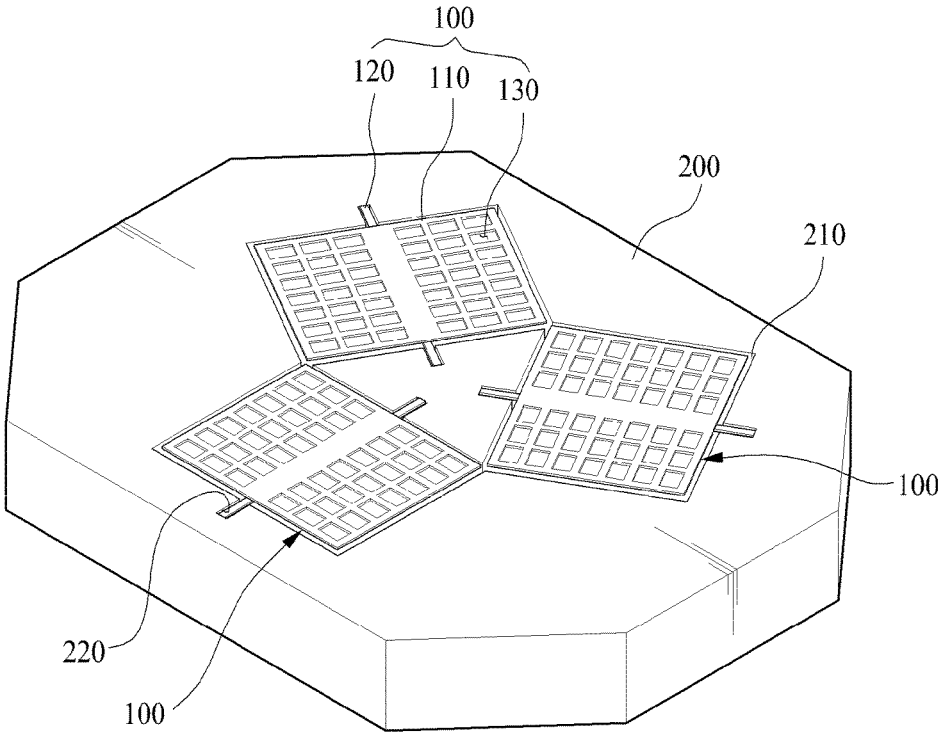

[Fig. 23]
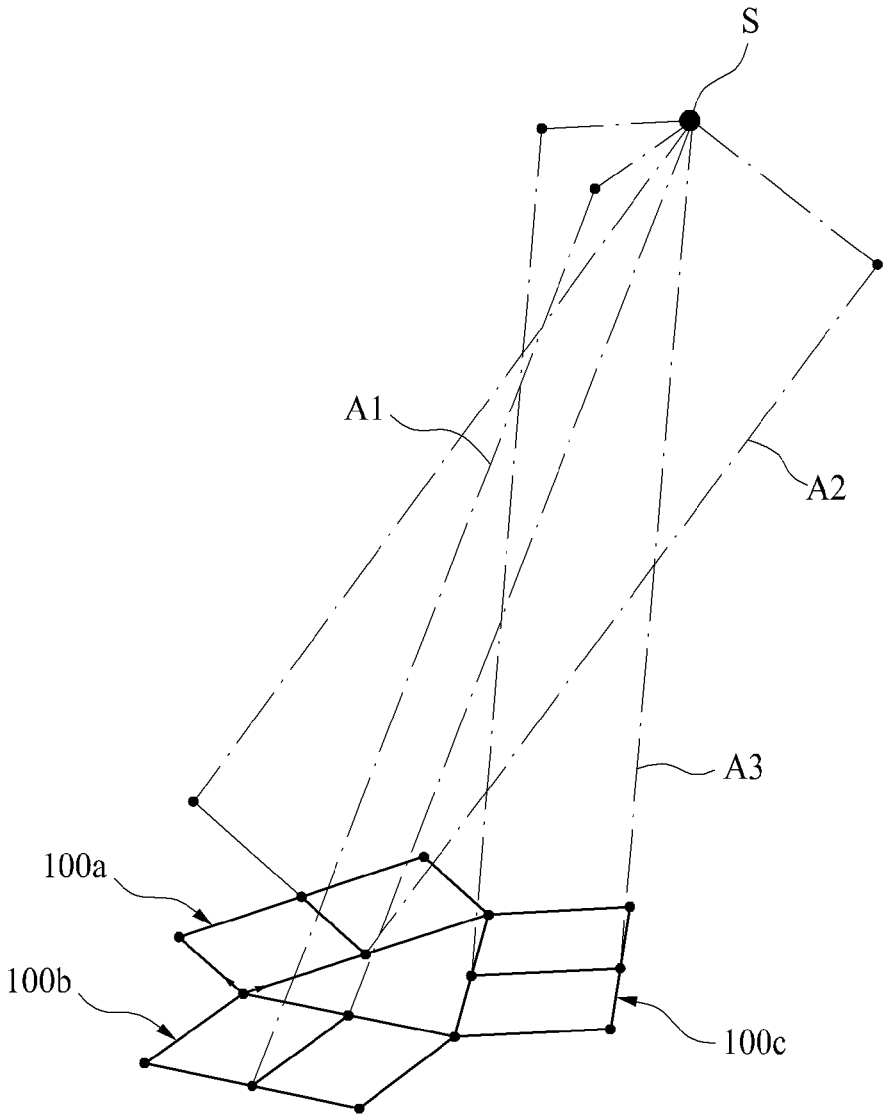

MICROPHONE

CROSS REFERENCE TO PRIOR APPLICATIONS

This application is a National Stage Application of PCT International Patent Application No. PCT/KR2016/000189 filed on Jan. 8, 2016, under 35 U.S.C. § 371, which claims priority to Korean Patent Application Nos. 10-2015-0002931 filed on Jan. 8, 2015, 10-2015-0002938 filed on Jan. 8, 2015, and 10-2015-0019921 filed on Feb. 10, 2015, which are all hereby incorporated by reference in their entirety.

TECHNICAL FIELD

The present invention relates to a microphone, and more particularly, to a microphone, which can accurately measure the strength and the direction of a voice by precisely sensing the vibration of a vibration plate, self-inspect whether the microphone normally operates, and accurately measure the location of a sound source.

BACKGROUND ART

The most important feature of a microphone is a function to amplify a sound and a function to measure directionality of the sound.

Since there have been many researches into the function to amplify the sound from the past, there is no big problem. However, as for the function to measure the directionality of the sound, in the related art, two independent microphones without the function to measure the directionality of the sound are spaced apart from each other at a predetermined distance to measure the directionality of the sound by measuring a difference of sound pressure and a phase difference of sound waves according to a direction of the sound wave. In this case, when the distance between two microphones is very short, signals of the two microphones are very similar to each other, and as a result, it is almost impossible to find the directionality of the sound.

In particular, since a low-frequency sound has a long wavelength, it is further difficult to distinguish phases of the sound waves. For this reason, miniaturization of the microphone having the function of the directionality has a limit.

DISCLOSURE

Technical Problem

An object of the present invention is to provide a microphone which can accurately measure the strength and the direction of a sound, self-inspect whether the microphone normally operates, and measure the location of a sound source.

Technical Solution

In order to solve the problem, according to an aspect of the present invention, disclosed is a microphone including: a vibration member having a plate shape, and formed so as to have elasticity and cause bending due to sound waves; a case having a depressed groove, which forms an air layer between the depressed groove and the vibration member since the vibration member is stacked on an upper part thereof, and coupled to the upper part of the depressed groove such that the vibration member can be vibrated by sound waves; and a vibration detection unit provided on the vibration unit and the case and measuring the vibration of the vibration member vibrating by sound waves on the case, wherein, when the vibration member vibrates, the air in the air layer flows so as to damp the vibration of the vibration member.

The case may include a coupling protrusion which is formed to protrude upward in the depressed groove and in which the vibration member is seated on an upper end, and the vibration member may include a coupling part coupled with the coupling protrusion while facing the coupling protrusion on the bottom so as to be vibrated by external force around the center in a horizontal direction.

The coupling protrusion and the coupling part may be integrally configured to have elasticity, and as a result, the vibration member may be configured to vibrate with predetermined damping.

The microphone may further include hinge parts which are formed to protrude in both directions in the horizontal direction of the vibration member and serve as a rotary axis when the vibration member vibrates and may be rocked, in which the air layer may be formed between the vibration member and the depressed groove by the hinge parts.

The vibration member may include at least one communication hole formed so that the air may communicate therethrough.

A plurality of sizes or numbers of communication holes may be controlled to control damping of passed air.

The vibration sensing unit may include a first electrode disposed in the depressed groove in an upper direction, a second electrode formed at a corresponding location while facing the first electrode on the vibration member, and a sensing means applying voltages having different polarities to the first and second electrodes and sensing that capacitance between the first and second electrodes is changed with the movement of the vibration member by the air on the case to measure vibration of the vibration member.

The vibration sensing unit may include a first grating unit formed to protrude in the horizontal direction on the vibration unit and of which location is changed with the vibration of the vibration unit, a second grating unit of which location is fixed while engaging with the first grating unit on the case, a light source provided on the case and emitting light toward the first grating unit or the second grating unit, and a light detecting unit receiving light reflected from the first grating unit or the second grating unit or passing between the first grating unit and the second grating unit to measure the vibration of the vibration unit.

The microphone may further include a vibration generating unit receiving alternating current (AC) or AC voltage and vibrating the vibration unit and the vibration sensing unit may be provided to sense whether the vibration unit vibrates with a predetermined strength in response to the strength of the AC or AC voltage applied to the vibration generating unit.

The vibration generating unit may include a third electrode disposed in the upper direction in the depressed groove and disposed to be separated from the vibration sensing unit disposed in the case, a fourth electrode disposed to be separated from the vibration sensing unit disposed on the vibration unit while facing the third electrode on the vibration unit, and a power applying unit connected to the third electrode and the fourth electrode to selectively apply the AC or AC voltage, and the vibration generating unit may be provided to vibrate the vibration unit through electrostatic force applied between the third electrode and the fourth electrode.

A plurality of vibration members may be provided on the case, a plurality of depressed grooves is formed as many as the vibration members, and the plurality of vibration members may be disposed not to be parallel to each other to be independently vibrated by sound waves generated from a sound source and the vibration sensing units may be provided in the vibration members as many as the vibration members to measure the vibrations of the respective vibration member which independently vibrate.

The vibration members may vibrate with the hinge parts provided in the plurality of vibration members as rotary axes, respectively and the vibration members may be disposed so that the rotary axes cross each other.

Three vibration members may be provided on the case and disposed to form a triangular shape by respective ends.

Advantageous Effects

According to the microphone of the present invention, the following effects are obtained.

First, the vibration of the vibration member which is vibrated by the sound wave is measured for each location and the strength and the location of the sound wave are measured through a measurement value for the vibration to perform both miniaturization and voice direction measurement of the microphone.

Second, a pair of electrodes are provided on the vibration member which is vibrated by the sound wave and the case supporting the vibration member, respectively, and the vibration of the vibration member can be more precisely sensed through the change in capacitance between the electrodes.

Third, the strength of the power applied by the power applying unit and the vibration strength of the vibration unit which vibrates are compared with each other in the vibration generating unit to measure whether the vibration unit normally operates and perform self-inspection, thereby enhancing reliability.

Fourth, a plurality of vibration members which vibrates by the sound wave is disposed so that rotary shafts cross each other to measure the vibration by the sound wave for each location and measure the strength and the location of the sound wave through a measurement value for the vibration, thereby performing both miniaturization and location measurement of a sound source of the microphone.

The effects of the present invention are not limited to the aforementioned effect, and other effects, which are not mentioned above, will be apparent to a person having ordinary skill in the art from the description of the claims.

DESCRIPTION OF DRAWINGS

FIG. 1 is a diagram illustrating an auditory structure of Ormia ochracea in the related art;

FIG. 2 is a diagram illustrating the auditory structure of the Ormia ochracea of FIG. 1 as a mechanical system;

FIG. 3 is a diagram illustrating each vibration mode of a bar of FIG. 2;

FIG. 4 is a graph illustrating experimental data when a damping ratio of an eardrum is critical damping in the auditory structure of the Ormia ochracea of FIG. 1;

FIG. 5 is a graph illustrating the experimental data when the damping ratio of the eardrum is 10 times in the auditory structure of the Ormia ochracea of FIG. 1;

FIG. 6 is a graph illustrating the experimental data when the damping ratio of the eardrum is 0.1 times in the auditory structure of the Ormia ochracea of FIG. 1;

FIG. 7 is a graph illustrating the experimental data when the damping ratio of the eardrum is non-damping in the auditory structure of the Ormia ochracea of FIG. 1;

FIG. 8 is a perspective view schematically illustrating a microphone according to a first embodiment of the present invention;

FIG. 9 is a cross-sectional view of the microphone of FIG. 8;

FIG. 10 is a diagram schematically illustrating a state in which a sound wave is transferred to the microphone of FIG. 8 and vibrates;

FIG. 11 is a perspective view schematically illustrating a vibration member in the microphone of FIG. 8;

FIG. 12 is a perspective view schematically illustrating a microphone according to a second embodiment of the present invention;

FIG. 13 is a cross-sectional view of FIG. 12;

FIG. 14 is a diagram illustrating a state in which a vibration member vibrates in the microphone of FIG. 12;

FIG. 15 is a cross-sectional view of a microphone according to a third embodiment of the present invention;

FIG. 16 is a diagram illustrating a state in which a vibration member vibrates in the microphone of FIG. 15;

FIG. 17 is a perspective view of a microphone according to a fourth embodiment of the present invention;

FIG. 18 is a cross-sectional view of FIG. 17;

FIG. 19 is a diagram illustrating a state in which a vibration member vibrates in the microphone of FIG. 17;

FIG. 20 is a cross-sectional view of the microphone according to the fourth embodiment of the present invention;

FIG. 21 is a diagram illustrating a state in which a vibration member vibrates in the microphone of FIG. 20;

FIG. 22 is a perspective view schematically illustrating a microphone according to a sixth embodiment of the present invention; and FIG. 23 is a diagram virtually illustrating a state in which a plurality of vibration members tracks a location of a sound source by detecting a sound wave in the microphone of FIG. 22.

BEST MODE

Preferred embodiments of the present invention configured as such will be described with reference to the accompanying drawings. However, this is not intended to limit the present invention to a specific form, but to provide a clearer understanding of the present invention.

In describing the embodiments, the same name and the same reference numeral are used with respect to the same component and the resulting additional description will be omitted.

Prior to describing a microphone 100 according to the present invention, a conventional implementation model U.S. Pat. No. 7,826,629 has been reviewed to determine whether damping (hereinafter, referred to as 'Cs') which occurs by a hinge part and a vibration member is critical damping, that is, whether a damping ratio needs to be close to 1.

In the model according to the US patent, a case is opened to a lower side so that the damping due to a fluid does not occur, and only the damping due to rocking of the hinge part and bending of the vibration member exists.

Therefore, even though the present US invention is rated as the most advanced model of an auditory model of Ormia ochracea, the present US invention may not implement critical damping like Ormia ochracea, so the present US invention may not show a difference in vibration between both eardrums like Ormia ochracea.

Other studies have the same performance as orchestration of Ormia ochracea because the other studies fail to achieve optimal damping, that is, critical damping.

Therefore, the biggest problem for implementing the auditory model of the Ormia ochracea is how to implement the critical damping expressed as a predetermined value in the embodiment of the present invention.

FIG. 1 is a diagram illustrating an auditory structure of Ormia ochracea which is known, FIGS. 2 and 3 are diagrams illustrating the auditory structure of the Ormia ochracea of FIG. 1 as a mechanical system, FIGS. 4 to 7 are graphs illustrating data acquired by performing an experiment while changing a damping ratio of an eardrum in the auditory structure of the Ormia ochracea of FIG. 1, and FIG. 4 illustrates a case where Cs is critical damping, FIG. 5 illustrates a case where Cs is damped to 10 times of the critical damping, FIG. 6 illustrates a case where Cs is damped to 0.1 times of the critical damping, and FIG. 7 illustrates a case where there is no damping.

First, when a method for measuring a direction in the auditory structure of the Ormia ochracea is described in detail, Equation of Motion for the auditory structure of the Ormia ochracea is described below.

$$\begin{bmatrix} I & O \\ O & I \end{bmatrix}\begin{bmatrix} \ddot{\theta}_1 \\ \ddot{\theta}_2 \end{bmatrix} + \begin{bmatrix} C_sL + C_t & C_t \\ C_t & C_sL + C_t \end{bmatrix}\begin{bmatrix} \dot{\theta}_1 \\ \dot{\theta}_2 \end{bmatrix} + \begin{bmatrix} K_sL + K_t & K_t \\ K_t & K_sL + K_t \end{bmatrix}\begin{bmatrix} \theta_1 \\ \theta_2 \end{bmatrix} = \begin{bmatrix} T_1 \\ T_2 \end{bmatrix}$$

Based on the aforementioned equation, when a sound wave of 5 kHz reaches each eardrum of the Ormia ochracea at an inter-aural time difference (ITD) of 2.5 μsec with the same size, the eardrums vibrate with a phase difference of 50 μsec and a size difference of 10 dB, respectively.

The reason is that two eardrums of the Ormia ochracea are mechanical systems coupled based on a bending mode and a rocking mode which are two types of vibration modes.

Herein, the bending mode means a case where a hinge part connecting both eardrums is bent and the rocking mode means a case where the hinge part is rocked.

Meanwhile, the eardrum at a side to which the sound wave is first applied partially rotates even in the same direction as the eardrum at the other side due to coupling and damping through the hinge part, and when the same sound wave reaches the eardrum at the other side due to such a coupled effect, an effect to reduce the amount of rotation is caused due to the sound wave.

In conclusion, even if the sound wave are transmitted to both eardrums with the same size, the eardrum at a side that first receives the sound wave by the damping and coupling with a relatively larger strength to measure the direction of the sound wave.

Coupling damping of both eardrums needs to be implemented in order to configure the microphone in which the direction of the sound wave may be known by using such a principle.

Referring to FIGS. 2 to 7, in coupling damping (hereinafter, referred to as 'Ct') between both eardrums in an auditory model of the Ormia ochracea, a material itself needs to be damped, but since such a material does not almost exist, Ct is assumed as 0 and when only Cs exists, it can be seen that a difference in vibration size is very large by comparing a case in which a value of Cs is in critical damping and a case in which the value of Cs is not in the critical damping.

Herein, a point having the largest difference is shown at a resonance frequency when the hinge part is rocked, that is, approximately 7 kHz.

Further, since Ct is assumed as 0, when the point is close to a resonance frequency when a vibration member is bent, that is, approximately 30 kHz, a vibration difference between left and right beams is rapidly reduced. According to such an analysis result, in order to clearly implement a sound detection function through the auditory model of the Ormia ochracea, it is illustrated that Cs needs to be close to the critical damping, that is, the damping ratio needs to be close to 1.

A microphone according to a first embodiment of the present invention will be described based on such contents.

A configuration of the microphone according to a first embodiment of the present invention will be described below with reference to FIGS. 8 to 11.

FIG. 8 is a perspective view schematically illustrating a microphone according to a first embodiment of the present invention, FIG. 9 is a cross-sectional view of the microphone of FIG. 8, FIG. 10 is a diagram schematically illustrating a state in which a sound wave is transferred to the microphone of FIG. 8, which vibrates, and FIG. 11 is a perspective view schematically illustrating a vibration member in the microphone of FIG. 8.

The microphone according to the present invention as a device that may detect vibration of the vibration member which vibrates by the sound wave and determine a location of a source where the sound wave is generated largely includes a vibration member 100, a case 200, and a vibration sensing unit 300.

The vibration member 100 is formed in a thin plate shape and is configured to vibrate by the generated sound wave, thereby serving as a medium for measuring the direction of the sound wave.

In detail, in the first embodiment of the present invention, the vibration member 100 is manufactured through a micro-electro mechanical systems (MEMS) process, but is not limited thereto.

The vibration member 100 configured as described above is configured to have elasticity by air and to be bent, and as a result, the vibration is generated by the sound wave and at least a part of the vibration member 100 is configured to have the elasticity and vibrates to damp the sound wave.

The vibration member 100 generally includes a plate member 110, a hinge part 120, and a communication hole 130 as illustrated in FIG. 11.

The plate member 110 is formed in the thin plate shape and is coupled with the case 200 to be described below so as to vibrate by the sound wave which is applied from the outside to be configured to have the elasticity.

In addition, when the sound wave is applied to the plate member 110, the plate member 110 is configured to be vibrated and bent to damp the vibration.

In the embodiment, the plate member 110 has a rectangular shape and includes the hinge part 120 which protrudes to correspond to each other.

In detail, the hinge part 120 protrudes in both directions along a horizontal direction of the vibration member 100 and serves as a rotary axis when the plate member 110 vibrates and is configured to be rocked.

In addition, the hinge part 120 couples the plate member 110 and the case 200 with each other so that the plate member 110 is vibrated by the sound wave on the case 200. Herein, the plate member 110 and the case 200 are coupled to each other so that an air layer is formed between the plate member 110 and the case 200 by the hinge part 120.

In the embodiment, the hinge part 120 may be integrally formed with the plate member 110 as illustrated and when the plate member 110 is vibrated by the sound wave, the plate member 110 is rocked, and as a result, restoration force is applied to the plate member 110 to damp the vibration of the plate member 110.

In this case, the hinge part 120 is formed at both sides of the center of the plate member 110 and becomes a central axis of the vibration when the plate member 110 vibrates.

That is, when the plate member 110 vibrates by the sound wave, the plate member 110 vibrates around the hinge part 120 and the hinge part 120 is rocked to damp the vibration of the plate member 110.

Meanwhile, the communication hole 130 vertically communicates on the plate member 110 and the vibration of the plate member 110 which vibrates in reaction with the applied sound wave is damped.

In detail, the communication hole 130 serves as a passage through which air which exists on the air layer formed between the case 200 and the plate member 110 passes when the plate member 110 vibrates.

The communication hole 130 is configured as described above, and as a result, additional damping is provided together with the bending of the plate member 110 and the rocking of the hinge part 120 while the air passes through the communication hole 130 when the plate member 110 vibrates to damp the vibration of the plate member 110.

As a result, when the vibration member 100 vibrates, the damping by the plate member 110, the hinge part 120, and the communication hole 130 is configured to be close to the critical damping, that is, the damping ratio by the vibration member 100 is configured to be close to 1.

Herein, the damping by the vibration member 100 includes damping by the bending of the plate member 110, damping by the rocking of the hinge part 120, and damping from the air layer which moves through the communication hole 130 and the damping may be controlled through each material and elastic deformation.

Further, the size of the communication hole 130 and the number of the communication holes 130 are controlled to control damping of the vibration of the entirety of the vibration member 100 to be close to the critical damping.

In the present invention, the plate member 110 is formed to communicate by at least one communication hole 130 and a plurality of communication holes 130 may be configured as illustrated.

In addition, the plurality of communication holes 130 may be configured to control the damping of the passing air by controlling a size or the number thereof.

As described above, the vibration member 100 according to the present invention includes the plate member 110, the hinge part 120, and the communication hole 130 and the vibration member 100 vibrates so that the damping ratio becomes 1 when the vibration member 100 is vibrated by the sound wave.

Meanwhile, the case 200 according to the present invention as a component in which the vibration member 100 is coupled to vibrate around the hinge part 120 has a depressed groove 210 coupled so that the vibration member 100 may be vibrated by air since the vibration member is stacked on an upper part thereof.

The depressed groove 210 is depressed with a predetermined depth on the top of the case 200 and the vibration member 100 is seated on the upper part of the depressed groove 210 in a stacking shape.

Herein, the vibration member 100 is seated on the upper part of the depressed groove 210 and the air layer is formed between the plate member 110 and the case 200 by the depressed groove 210.

In detail, the case 200 according to the embodiment of the present invention may have the depressed groove 210 on the top thereof and a seating groove 220 which enables the hinge part 120 to be seated.

In addition, the hinge part 120 is seated on the seating groove 220, and as a result, the air layer is formed between the depressed groove 210 and the plate member 110 and the damping of the vibration member 100 is controlled by the air layer.

As a result, the hinge part 120 is seated in the seating groove 220, and as a result, the plate member may not be separated but be stably positioned at the upper part of the depressed groove 210 on the case 200.

In the embodiment, the depressed groove 210 has a uniform separation distance from the plate member 110 and is formed to correspond to a shape of the vibration member 100 and a thickness of the air layer is controlled according to a depth of the depressed groove 210, and as a result, the damping of the vibration member 100 is formed to be close to the critical damping.

Meanwhile, the vibration sensing unit 300 according to the embodiment as a component for measuring the strength and the location of the sound wave by sensing the separation distance form the depressed groove 210 when the plate member 110 is vibrated by the sound wave largely includes a first electrode 320, a second electrode 320, and a sensing means 330.

The first electrode 320 is disposed in an upper direction in the depressed groove 210 and the second electrode 310 is formed on the vibration member 100 at a corresponding location while facing the first electrode 320.

A power source is connected to the first electrode 320 and the second electrode 310 to apply voltages having different polarities to the first electrode 320 and the second electrode 310, respectively. In this case, the first electrode 320 and the second electrode 310 are configured as a conductor and electric energy is accumulated between the first electrode 320 and the second electrode 310.

In addition, capacitance of the electric energy accumulated between the first electrode 320 and the second electrode 310 is sensed by the sensing means 330.

In detail, the air layer is provided between the first electrode 320 and the second electrode 310 to apply the voltages having the different polarities to the first electrode 320 and the second electrode 310, respectively.

As a result, the first electrode 320 and the second electrode 310 become the same state as a condenser and the electric energy is accumulated between the first electrode 320 and the second electrode 310.

Thereafter, when the plate member 110 is vibrated by the sound wave, the location of the second electrode 310 is changed by the vibration of the plate member 110 and the separation distance from the first electrode 320 is changed, and as a result, the capacitance sensed by the sensing means 330 is changed.

The capacitance, C may be represented as $$C = \frac{\varepsilon_0 KA}{d}$$

and herein, $\varepsilon_0$ represents permittivity of free space constant, K represents a dielectric constant of the material in the gap, A represents an overlapping area of two conductors, and d represents a distance between two conductors.

As the permittivity and the dielectric constant, in the present invention, since the air is filled between two conductors (the first electrode 320 and the second electrode 310), the permittivity and the dielectric constant of the air may be used. A also becomes a constant when the size and the location of the electrode are determined. Then, a change of the capacitance is in inverse proportion to the distance d between two conductors, and as a result, d may be acquired by dividing determined constants $\varepsilon_0$KA by the capacitance.

As described above, it is sensed that the capacitance between the first electrode 320 and the second electrodes is changed, and as a result, a change in separation distance between the first electrode 320 and the second electrode 310 may be sensed.

In this case, since the first electrode 320 is fixed onto the case 200, a vibration degree of the second electrode 310 may be determined, and as a result, it may be seen that the plate member 110 vibrates.

That is, the vibration sensing unit 300 senses the vibration of the plate member 110 by measuring the change in capacitance between the first electrode 320 and the second electrode 310 to measure the sound wave applied to the vibration member 100.

In detail, referring to FIG. 9, when the sound wave is not applied to the microphone according to the embodiment, the plate member 110 maintains a horizontal state around the hinge part 120.

In this case, the plate member 110 and the bottom surface of the depressed groove 210 are in the horizontal state and the separation distance between the first electrode 320 and the second electrode 310 becomes uniformly D1.

In addition, when the sound wave is generated at a right side and the plate member 110 vibrates as illustrated in FIG. 10, the plate member 110 vibrates while being bent to the right side around the hinge part 120, and as a result, the separation distance between the first electrode 320 and the second electrode 310 decreases to D2.

In this case, although not illustrated, a part of the plate member 110 is bent with the elasticity while the plate member 110 is vibrated by the sound wave, and as a result, the vibration is damped.

As described above, as the plate member 110 is vibrated by the sound wave, the separation distance between the first electrode 320 and the second electrode 310 is changed and the sensing means 330 senses the change in separation distance to measure the strength of the sound wave.

Meanwhile, although not illustrated in the figure, a plurality of vibration sensing units 300 is provided to be disposed while being separated from each other, and as a result, the vibration of the plate member 110 is sensed to measure the sound wave more accurately.

In addition, the vibration sensing units 300 are provided at both the left and right sides around the hinge part 210 in the plate member 110, and as a result, the vibration degrees of the plate member 110 are measured at respective locations to measure a generation direction of the sound wave through a difference between the vibration degrees.

As a result, the vibration of the plate member 110 which is vibrated by the sound wave is measured for each location and the strength and the location of the sound wave are measured through a measurement value for the vibration to achieve both miniaturization and voice direction measurement of the microphone.

Further, as described above, a pair of electrodes are provided on the vibration member 100 which is vibrated by the sound wave and the case supporting the vibration member 100, respectively, as described above and the vibration of the vibration member 100 may be more precisely sensed through the change in capacitance between the electrodes.

The microphone according to the present invention includes the vibration member 100, the case 200, and the vibration sensing unit 300 and when the vibration member 100 is vibrated by the sound wave, the change in capacitance between the first electrode 320 and the second electrode 310 is measured to measure the strength and the location of the sound wave.

Next, a second embodiment of the microphone according to the present invention will be described below with reference to FIGS. 12 to 14.

FIG. 12 is a perspective view schematically illustrating a microphone according to a second embodiment of the present invention, FIG. 13 is a cross-sectional view of the microphone of FIG. 12, and FIG. 14 is a diagram illustrating a state in which a vibration member 100 vibrates in the microphone of FIG. 12.

The microphone according to the second embodiment of the present invention largely includes the vibration member 100, the case 200, and the vibration sensing unit 300 as described above.

Herein, the configuration of the vibration sensing unit 300 is the same as that of the first embodiment, but the second embodiment is different from the first embodiment in the configurations of the vibration member 100 and the case 200.

In detail, in the case 200, the depressed groove 210 is formed similarly to the first embodiment, but a separate coupling protrusion 230 is further provided.

The coupling protrusion 230 protrudes in the upper direction in the depressed groove 210, and as a result, the vibration member 100 is configured to be seated at an upper end.

Referring to the illustrated drawing, the coupling protrusion 230 is singly formed at the center of the depressed groove 210 to protrude in the upper direction and configured to be coupled to the center of the plate member 110.

In this case, one coupling protrusion 230 is configured to be coupled with the plate member 110 so that the plate member 100 is vibrated by the sound wave.

Meanwhile, the vibration member 100 includes the plate member 100, the communication hole 130, and a coupling part 140 unlike the above description.

The plate member 110 and the communication hole 130 are formed in a metallic plate shape like these of the aforementioned first embodiment and a plurality of communication holes 130 vertically communicate with each other to be disposed in the horizontal direction.

However, the separate coupling part 140 is formed on the bottom of the plate member 110 to be coupled with the coupling protrusion 230 described above.

Herein, the coupling part 140 is formed at the center of the bottom of the plate member 110 and when the coupling part 140 is coupled with the coupling protrusion 230, the plate member 110 and the depressed groove 210 are disposed at corresponding locations to form the air layer having a uniform thickness.

In this case, the coupling part 140 and the coupling protrusion 230 are coupled with each other to provide the damping to the plate member 110 similarly to providing the damping to the plate member 110 through the rocking of the hinge part 120 described above.

Moreover, although not illustrated, the coupling part 140 and the coupling protrusion 230 may be integrally configured and configured to have the elasticity.

As described above, the coupling protrusion 230 is formed in the case 200 and the coupling part 140 is formed in and integrally coupled to the plate member 110, and as a result, the plate member 110 may more precisely vibrate when the plate member 110 is vibrated by the sound wave.

In addition, the first electrode 320 is provided in the depressed groove 210 and the second electrode 310 is provided on the bottom of the plate member 110, and as a result, the change in separation distance between the first electrode 320 and the second electrode 310 is sensed through the sensing means 330 when the plate member 110 vibrates to sense the vibration of the plate member 110.

Hereinafter, the configuration of a microphone according to a third embodiment of the present invention will be described below with reference to FIGS. 15 to 16.

FIG. 15 is a cross-sectional view of a microphone according to a third embodiment of the present invention and FIG. 16 is a diagram illustrating a state in which a vibration member 110 vibrates in the microphone of FIG. 15.

The microphone according to the embodiment, as a device that may sense the vibration of a vibration unit 100 which is vibrated by the sound wave and sense whether the vibration unit 100 normally operates, largely includes the vibration unit 100, the case 200, the vibration sensing unit 300, and a vibration generating unit 400.

Since the vibration unit 100, the case 200, and the vibration sensing unit 300 are substantially the same as the vibration unit 100, the case 200, and the vibration sensing unit 300 of the first embodiment, a detailed description thereof will be omitted.

Meanwhile, the vibration generating unit 400 according to the embodiment, as a component used for vibrating the plate member 110 by applying separate external force rather than the air to the vibration unit 100, largely includes a third electrode 420, a fourth electrode 410, and a power applying unit 430.

The third electrode 420 is configured as a conductor to be disposed in the upper direction in the depressed groove 210 and the fourth electrode 410 is disposed at a corresponding location while facing the third electrode 420 on the vibration unit 100.

Herein, each of the third electrode 420 and the fourth electrode 410 is configured as the conductor in which power may flow and the third electrode 420 and the fourth electrode 410 are disposed to face each other in the depressed groove 210.

In this case, the third electrode 420 and the fourth electrode 410 are preferably disposed to be biased toward one side around the hinge part 120 in the vibration unit 100.

In the embodiment, the first electrode 320 and the second electrode 310 are disposed while facing each other at one end around a pivot shaft of the plate member 110.

Meanwhile, the power applying unit 430 is connected to the first electrode 320 and the second electrode 310 to apply alternating current (AC) or AC voltage.

When the third electrode 420 and the fourth electrode 410 receive the AC voltage or AC from the power applying unit 430 while the third electrode 420 and the fourth electrode 410 are separated from each other, electrostatic force is generated between the third electrode 420 and the fourth electrode 410, which are attracted to each other.

In this case, since the third electrode 420 is fixed onto the top in the depressed groove 210 on the case 200, the third electrode 410 is attracted by the generated electrostatic force, and as a result, the plate member 110 is tilted around the hinge axis.

As the AC or the AC voltage is applied to the third electrode 420 and the fourth electrode 410 through such a principle, the separation distance between the third electrode 420 and the fourth electrode is repeatedly close to each other and the plate member 110 vibrates.

Herein, the strength of the electrostatic force applied between the third electrode 420 and the fourth electrode 410 is changed according to the strength of the power applied by the power applying unit 430 and when the strength of the electrostatic force applied by the power applying unit 430 increases, the separation distance of the third electrode 420 and the fourth electrode 410 decreases.

The vibration generating unit 400 configured as such applies the power rather than the external force such as the sound wave or the air to allow a user to select the vibration unit 100 to artificially generate the vibration.

In this case, since the AC voltage or AC which the power applying unit 430 applies to the third electrode 420 and the fourth electrode 410 has a pulse, the electrostatic force applied between the third electrode 420 and the fourth electrode 410 is repeatedly generated and disappears, and as a result, the plate member 110 vibrates.

That is, the vibration generating unit 400 according to the present invention applies an electric signal to the third electrode 420 and the fourth electrode 410 to artificially vibrate the vibration unit 100.

As a result, the vibration unit 100 according to the present invention may be vibrated by the vibration generating unit 400 or vibrated by a separate sound wave and measure the vibration of the vibration unit 100 through the vibration sensing unit 300.

The vibration sensing unit according to the embodiment is a component that is provided on the vibration unit 100 and sense whether the vibration unit 100 vibrates with a predetermined strength in response to the strength of the AC or the AC voltage applied to the vibration generating unit 400.

Since the configuration of the vibration sensing unit 300 is substantially the same as the vibration sensing unit 300 of the first embodiment, the detailed description thereof will be omitted.

As illustrated in FIG. 15, when separate external force is not applied to the microphone of the embodiment, the plate member 110 maintains the horizontal state around the hinge part 120.

In this case, the plate member 110 and the bottom surface of the depressed groove 210 are in the horizontal state and the separation distance between the first electrode 320 and the second electrode 310 becomes uniformly D1 and since the plate member 110 does not vibrate, the capacitance is not changed.

In addition, when the separation distance of the third electrode 420 and the fourth electrode 410 provided at the right side repeatedly increases and decreases and the plate member 110 is vibrated by the vibration generating unit 400 as illustrated in FIG. 16, the plate member 110 vibrates while bent to the right side around the hinge part 120, and as a result, the separation distance between the first electrode 320 and the second electrode 310 is changed to D2.

As described above, as the plate member 110 is vibrated by the vibration generating unit 400, the separation distance between the first electrode 320 and the second electrode 310 is changed and sensed by the sensing means to measure the vibration of the plate member 110.

In addition, the sensing means 330 configured as such may verify whether the vibration unit 100 vibrates with the predetermined strength in response to the strength of the AC or the AC voltage applied by the vibration generating unit 400.

Moreover, the vibration of the plate member 110 which is vibrated by not the vibration generating unit 400 but the sound wave is measured for each location and the strength and the location of the sound wave are measured through the measurement value for the vibration to achieve both the miniaturization and the voice direction measurement of the microphone.

Meanwhile, although not illustrated, a plurality of vibration sensing units 300 may be disposed to be separated from each other, and as a result, the vibration of the plate member 110 may be more accurately sensed.

As described above, the microphone according to the present invention includes the vibration unit 100, the case 200, the vibration sensing unit 300, and the vibration generating unit 400, and the strength of the power applied by the power applying unit 100 and the vibration strength of the vibration unit 100 which vibrates are compared with each other in the vibration generating unit 400 to measure whether the vibration unit 100 normally operates, thereby performing a self-inspection function.

Next, a fourth embodiment of a microphone according to the present invention will be described below with reference to FIGS. 17 and 19.

FIG. 17 is a perspective view schematically illustrating a microphone according to a fourth embodiment of the present invention, FIG. 18 is a cross-sectional view of FIG. 17, and FIG. 19 is a diagram illustrating a state in which the vibration unit 100 vibrates in the microphone of FIG. 17.

The microphone according to the fourth embodiment of the present invention may include the vibration unit 100, the case 200, and a vibration sensing unit 500. In this case, since the vibration unit 100 and the case 200 are substantially the same as those of the first embodiment described above, the detailed description thereof will be omitted and the vibration sensing unit 500 which is a difference from the first embodiment will be primarily described.

In detail, the vibration sensing unit 500 senses the vibration of the vibration unit 100 through not the change in electrical capacitance like the first embodiment described above but an optical method.

The vibration sensing unit 500 according to the fourth embodiment of the present invention includes first grating units 510, second grating units 520, light sources 530, and light detecting units 540.

The first grating units 510 face each other on the vibration unit 100 and are molded to protrude to both sides in the horizontal direction, and a result, the locations of the first grating units 510 are changed according to the vibration of the vibration unit 100.

In detail, at least one first grating unit 510 is molded to protrude at both ends in the horizontal direction around the hinge part 120 on the plate member 110 as illustrated.

In addition, when the plate member 110 is vibrated by the vibration generating unit 300 or the sound wave, the first grating unit 510 vibrates together with the plate member 110 and the location of the plate member 110 is changed.

The second grating unit 520 is configured similarly to the first grating unit 510 and a plurality of second grating units 510 is formed to protrude in parallel to protruded directions of the first grating units 510 and disposed to be adjacent to the depressed groove 210 on the top of the case 200.

Herein, while the second grating unit 520 engages with the first grating unit 510 on the case 200, the location of the second grating unit 520 is fixed.

In the embodiment, a plurality of second grating units 520 is formed protrude while facing the first grating units 510 and when the location of the first grating unit 510 is changed, the first grating unit 510 is configured to pass through a space between the second grating units 520.

That is, when the plate member 110 is vibrated around the hinge part 120 through the vibration generating unit 300 or the sound wave applied from the outside, a displacement of the first grating unit 510 varies, but the second grating unit 520 is fixed to the case 200, and as a result, the displacement of the second grating unit 520 does not vary.

Such a configuration is used for implementing an interferometer using a fixed grating and a moving grating and it can be seen that the plate member 110 vibrates through the interferometer.

The first grating unit 510 and the second grating unit 520 are provided to engage with each other and the vibration of the plate member 110 is measured through light interference by the light source 530 and the light detecting unit 540 to be described below.

Meanwhile, the light source 530 as a component that emits light toward the first grating unit 510 or the second grating unit 520 is provided on the case 200.

In this case, the light emitted from the light source 530 is preferably disposed to cross the protruded direction of the first grating unit 510 or the second grating unit 520.

In addition, the light detecting unit 540 receives light reflected from the first grating unit 510 or the second grating unit 520 or passing between the first grating unit 510 and the second grating unit 520 to measure the vibration of the vibration unit 100.

The light detecting unit 540 may be configured by a general light sensor and is provided to sense the light emitted from the light source 530.

In the embodiment, the light detecting unit 540 is disposed to face the light source 530 on the case 200 and senses the light passing between the first grating unit 510 and the second grating unit 520.

In this case, although not illustrated, a plurality of light sources 530 and light detecting units 540 are disposed on the top of the case 200 to be consecutively disposed in a longitudinal direction of the first grating unit 510.

As a result, although a vibration range of the plate member 110 is minute, a relative positional change of the first and second grating units 510 and 520 is more precisely measured to determine the vibration of the plate member 110.

Of course, unlike this, the light detecting unit 540 may be configured to sense the light which is emitted from the light source 530 and reflected on the first grating unit 510 or the second grating unit 520 and the location of the light detecting unit 540 on the case 200 may be adjusted by selection by the user.

In detail, when the state in which the vibration sensing unit 500 according to the second embodiment of the present invention senses the vibration of the plate member 110 is described, in the case where the separate external force is not applied to the microphone as illustrated in FIG. 18, the plate member 110 maintains the horizontal state around the hinge part 120.

In this case, the plate member 110 and the bottom surface of the depressed groove 210 are in the horizontal state and the first and second grating units 510 and 520 do not engage with each other.

In this case, although the light is emitted from the light source 530, the light is reflected by the first grating unit 510, and as a result, the light is not sensed by the light detecting unit 540.

In addition, when the separation distance of the first electrode 320 and the second electrode 310 provided at the right side repeatedly decreases and the plate member 110 is vibrated as illustrated in FIG. 19, the plate member 110 is bent to the right side around the hinge part 12 and the first and second grating units 510 and 520 engage with each other.

Herein, as the location of the first grating unit 510 moves in a lower direction, the light emitted from the light source 530 is not blocked by the first grating unit 510 but transferred to the light detecting unit 540.

As described above, as the plate member 110 is vibrated by the vibration generating unit 300, the light emitted from the light source 530 is sensed by the light detecting unit 540 to measure the vibration of the plate member 110.

In this case, the plurality of light sources 530 and light detecting units 540 are provided to be separated from each other in the protruded direction of the first grating unit 510, and as a result, the vibration degree of the plate member 110 may be more precisely measured.

Of course, unlike this, the layouts of the light source 530 and the light detecting unit 540 are adjusted to allow the first or second grating unit 510 or 520 to reflect or scatter the light emitted from the light source 530 and allow the light detecting unit 540 to sense the reflected or scattered light to be configured to sense the vibration of the plate member 110.

As described above, the vibration sensing unit 500 according to the second embodiment of the present invention may include the first grating units 510, the second grating units 520, the light sources 530, and the light detecting units 540 and optically measure the vibration of the plate member 110 unlike the first embodiment described above.

Next, a fifth embodiment of a microphone according to the present invention will be described below with reference to FIGS. 20 and 21.

FIG. 20 is a cross-sectional view of a microphone according to a fifth embodiment of the present invention and FIG. 21 is a diagram illustrating a state in which the vibration unit 100 vibrates in the microphone of FIG. 20.

The microphone according to the fifth embodiment of the present invention largely includes the vibration unit 100, the case 200, the vibration sensing unit 300, and the vibration generating unit 400 like the first embodiment.

Herein, the configurations of the vibration sensing unit 300 and the vibration generating unit 400 are the same as those of the first embodiment described above, but the fifth embodiment is different from the first embodiment in the configurations of the vibration unit 100 and the case 200.

In detail, in the case 200, the depressed groove 210 is formed similarly to the first embodiment, but the separate coupling protrusion 230 is further provided.

The coupling protrusion 230 protrudes in the upper direction in the depressed groove 210, and as a result, the vibration unit 100 is configured to be seated at the upper end.

Referring to the illustrated figure, the coupling protrusion 230 is singly formed at the center of the depressed groove 210 to protrude in the upper direction and configured to be coupled to the center of the plate member 110.

In this case, one coupling protrusion 230 is configured to be coupled with the plate member 110 so that the plate member 100 is vibrated by the vibration generating unit 300 or the sound wave.

Meanwhile, the vibration unit 100 includes the plate member 110, the communication hole 130, and the coupling part 140 unlike the above description.

The plate member 110 and the communication hole 130 are formed in the metallic plate shape and a plurality of communication holes 130 vertically communicate to be disposed in the horizontal direction similarly to the first embodiment described above.

However, the separate coupling part 140 is formed on the bottom of the plate member 110, and as a result, the coupling part 140 is coupled with the coupling protrusion 230 described above.

Herein, the coupling part 140 is formed at the center of the bottom of the plate member 110 and when the coupling part 140 is coupled with the coupling protrusion 230, the plate member 110 and the depressed groove 210 are disposed at corresponding locations to form the air layer having a uniform thickness.

In this case, the coupling part 140 and the coupling protrusion 230 are coupled to provide the damping to the plate member 110 similarly to providing the damping to the plate member 110 through the rocking of the hinge part 120.

Moreover, although not illustrated, the coupling part 140 and the coupling protrusion 230 may be integrally configured and configured to have the elasticity.

As described above, the coupling protrusion 230 is formed in the case 200 and the coupling part 140 is formed in the plate member 110 and the coupling protrusion 230 and the coupling part 140 are integrally coupled to each other, and as a result, the plate member 110 may more precisely vibrate when the plate member 110 vibrates.

In addition, the first electrode 320 is provided in the depressed groove 210 and the second electrode 310 is provided on the bottom of the plate member 110, and as a result, the change in separation distance between the third electrode 320 and the second electrode 310 is sensed through the sensing means when the plate member 110 vibrates to sense the vibration of the plate member 110.

Further, the third electrode 420 and the fourth electrode 410 of the vibration generating unit 400 are also provided and the plate member 110 is vibrated by the electrostatic force generated by the applied AC and the vibration sensing unit 300 senses the vibration to sense whether the vibration unit 100 vibrates with the predetermined strength in response to the strength of the AC or the AC voltage applied to the vibration generating unit 400.

Hereinafter, a microphone according to a sixth embodiment of the present invention will be described.

FIG. 22 is a perspective view schematically illustrating the configuration of the microphone according to the embodiment.

The microphone according to the present invention, as a device that may detect vibration of the vibration member 100 which vibrates by the sound wave and determine a location of a source where the sound wave is generated, largely includes the vibration member 100, the case 200, and the vibration sensing unit 300.

The vibration member 100 is formed in a thin plate shape and is configured to vibrate by the generated sound wave, thereby serving as a medium for measuring the direction of the sound wave.

Herein, a plurality of vibration members 100 is provided to be disposed at different locations and each of the vibration members 100 is configured to be independently vibrated by the sound wave generated from a sound source S (see FIG. 7).

Since each vibration member 100 and the vibration sensing unit 300 are substantially the same as the vibration member 100 and the vibration sensing unit 300 of the first embodiment described above, the detailed description thereof is made with reference to the first embodiment described above.

Meanwhile, a plurality of vibration members 100 is provided and each of the vibration members 100 independently vibrates with the hinge part 120 as the rotary axis. In this case, the sound wave generated from the sound source S reaches each of the plurality of vibration members 100 to vibrate each vibration member 100.

Herein, the vibration member 100 vibrates in a manner that a virtual plane including the rotary axis of the vibration member 100 is determined while indicating the location of the sound source S and intersection points of the virtual planes determined from the plurality of vibration members 100 are found to determine the location of the sound source S.

In the embodiment, three vibration members 100 are provided as illustrated and one side of the plate member 110 is disposed to have an equilateral triangular shape.

That is, the rotary axes are disposed to radially cross each other with the hinge part 120 of each plate member 110 as the rotary axis, and as a result, the sound waves generated the sound source S independently reach and vibrate each of the vibration members 100.

As described above, the vibration members 100 have the triangular shape and the respective vibration members 100 are independently vibrated by the sound waves generated from the sound source S.

Of course, unlike this, more vibration members 100 than three are provided and the respective vibration members 100 may be disposed not to be parallel to each other.

Herein, as three or more vibration members 100 are provided, the sound waves generated from the sound source S reach and vibrate the respective vibration members 100.

In this case, each vibration member 100 vibrates in a manner that the virtual plane including the rotary axis of the vibration member 100 is determined while indicating the location of the sound source and the intersection points of the virtual planes determined from the plurality of vibration members 100 are found to determine the location of the sound source S.

Further, in the case 200 according to the present invention as a component in which the vibration member 100 is coupled to vibrate around the hinge part 120, the depressed grooves 210 in which each vibration member 100 is stacked on the upper part of the depressed groove 210 and to which each vibration member is coupled to vibrate by the sound wave are formed as many as the vibration members 100 and the seating groove 220 on which the hinge part 210 is seated is formed in each depressed groove 210.

In the embodiment, one case 200 is provided and a plurality of depressed grooves 210 is formed to correspond to the layout of the plate member 110 on the case.

In detail, the depressed groove 210 is formed to be depressed on the top of the case 200 and as illustrated, the depressed groove 210 is formed to correspond to the plate member 110 so that the plate member 110 is disposed in a triangular shape.

Meanwhile, the vibration sensing unit 300 according to the embodiment, as a component for measuring the strength and the location of the sound wave by sensing the separation distance form the depressed groove 210 when the plate member 110 is vibrated by the sound wave, may generally include the first electrode 320, the second electrode 310, and the sensing means 330 and may be disposed for each vibration member 100.

In addition, since the vibration sensing unit 300 according to the embodiment is similar to the vibration sensing unit 300 according to the first embodiment, the detailed description will be made with reference to a description part of the vibration sensing unit 300 of the first embodiment described above.

When the plurality of vibration members 100 vibrates, the vibration sensing unit 300 independently senses the vibration of each vibration member 100.

In this case, the vibration sensing unit 300 may sense a vibration time difference among the plurality of respective vibration members 100 together and measure that the sound waves generated from the sound source S illustrated in FIG. 23 reach the vibration member 100 to vibrate with different strengths and time differences.

In this case, each vibration member 100 vibrates in such a manner that the virtual plane including the rotary axis of the vibration member 100 is determined while indicating the location of the sound source and the intersection points of the virtual planes determined from the plurality of vibration members 100 are found to sense the location of the sound source S.

That is, as described above, the vibration sensing units 300 are provided in all of the respective vibration members 100 and may measure the vibration degrees of the plate member 110 at respective locations to measure a sound source location through a difference of the measured vibration degrees.

As a result, the vibration of the plate member 110 which is vibrated by the sound wave is measured for each location and the strength and the location of the sound wave are measured through a measurement value for the vibration to achieve the voice direction measurement of the microphone.

Further, as described above, a pair of electrodes 310 and 320 are provided in one vibration member 100 which is vibrated by the sound wave and the case supporting the vibration member 100, respectively and the vibration of the vibration member 100 may be more precisely sensed through the change in capacitance between the electrodes.

The microphone according to the present invention includes the vibration member 100, the case 200, and the vibration sensing unit 300 and when the vibration member 100 is vibrated by the sound wave, the change in capacitance between the first electrode 320 and the second electrode 310 is measured to measure the strength and the location of the sound wave.

Subsequently, referring to FIG. 23, the state in which the microphone according to the present invention senses the location of the sound wave generated from the sound source S will be described below in more detail.

FIG. 23 is a diagram illustrating a state in which a plurality of vibration members 100 senses a sound wave in the microphone of FIG. 22.

Referring to the illustrated figure, three vibration members 100 are disposed on the case 200 to form a triangular shape and configured to vibrate by the sound wave generated from the sound source S.

Herein, three vibration members 100 will be described by dividing first to third vibration members 100*a* to 100*c* for easy description.

The first to third vibration members 100*a* to 100*c* are configured to vibrate in the respective rotary axes while forming the triangular shape on the case 200 as described above.

In this case, the rotary axes of the respective vibration members 100*a*, 100*b*, and 100*c* are disposed to radially cross each other, and as a result, the respective vibration members are preferably configured to vibrate in different directions.

In the embodiment, as illustrated, the vibration members 100*a*, 100*b*, and 100*c* may be disposed on the same plane and may be positioned in outer parts of three sides of an equilateral triangle, respectively. In addition, the vibration members 100*a*, 100*b*, and 100*c* need not form the equilateral triangle, but are disposed so that measurement planes of the respective vibration members 100*a*, 100*b*, and 100*c* do not overlap with each other, that is, are not parallel to each other.

In addition, the first to third vibration members 100*a* to 100*c* disposed as such have different separation distances from the sound source S.

As described above, the first to third vibration members 100*a* to 100*c* have different separation distances from the sound source S and the sound waves generated from the sound source S reach the plate members 110 provided at the first to third vibration members 100*a*, respectively to vibrate each vibration member 100.

As a result, the vibration sensing units 300 provided in the first to third vibration members 100*a* to 100*c*, respectively, independently measure the vibration degrees and the vibration directions of the respective plate members 110, and as a result, the vibration sensing unit 300 determines the location of the sound source S.

That is, the first to third vibration members 100*a* to 100*c* vibrate in such a manner that the virtual plane including the rotary axis of the vibration member 100 is determined while indicating the location of the sound source and the intersection points of the virtual planes determined from the plurality of vibration members 100 are found to sense the location of the sound source S.

In addition, the first to third vibration members 100*a* to 100*c* amplify the sound waves in response to the vibration strengths sensed by the vibration sensing units 300.

As described above, the microphone according to the present invention includes the plurality of vibration members 100, the case 200 having the depressed grooves 210 independently coupled as many as the vibration members 100 and disposed in different directions, and the plurality of vibration sensing units 300 measuring whether the respective vibration members 100 vibrate.

As a result, the directions and the strengths of the sound waves generated from the sound source S may be precisely measured.

As described above, the preferred embodiments of the present invention have been described, and the present invention can be embodied in other forms without departing from the spirit or scope of the present invention in addition to the aforementioned embodiment. Therefore, the embodiment is not limited to a specific form but should be considered to be illustrative, and as a result, the present invention is not limited to the above description and may be modified within the scope of the appended claims and a range equivalent thereto.

The invention claimed is:

1. A microphone comprising:

a vibration member having a plate shape and formed so as to have elasticity and cause bending due to sound waves;

a case having a depressed groove, which forms an air layer between the depressed groove and the vibration member since the vibration member is stacked on an upper part thereof, and coupled to the upper part of the depressed groove such that the vibration member is vibrated by sound waves; and a vibration detection unit provided on the vibration unit and the case and measuring the vibration of the vibration member vibrating by sound waves on the case, wherein the vibration sensing unit includes a first grating unit formed to protrude in the horizontal direction on the vibration unit and of which location is changed with the vibration of the vibration unit, a second grating unit of which location is fixed while engaging with the first grating unit on the case, a light source provided on the case and emitting light toward the first grating unit or the second grating unit, and a light detecting unit receiving light reflected from the first grating unit or the second grating unit or passing between the first grating unit and the second grating unit to measure the vibration of the vibration unit.

2. The microphone of claim 1, wherein the case includes a coupling protrusion which is formed to protrude upward in the depressed groove and in which the vibration member is seated on an upper end, and the vibration member includes a coupling part coupled with the coupling protrusion.

3. The microphone of claim 2, wherein the coupling protrusion and the coupling part are integrally configured to have elasticity, and as a result, the vibration member is configured to vibrate with predetermined damping.

4. The microphone of claim 1, wherein the vibration member includes at least one communication hole formed so that the air may communicate therethrough.

5. The microphone of claim 4, wherein a plurality of sizes or numbers of communication holes are controlled to control damping of passed air.

6. The microphone of claim 1, wherein the vibration sensing unit includes a first electrode disposed in the depressed groove in an upper direction, a second electrode formed at a corresponding location while facing the first electrode on the vibration member, and a sensing means applying voltages having different polarities to the first and second electrodes and sensing that capacitance between the first and second electrodes is changed with the movement of the vibration member by the air on the case to measure vibration of the vibration member.

7. The microphone of claim 1, further comprising:

a vibration generating unit receiving alternating current (AC) or AC voltage and vibrating the vibration unit, wherein the vibration sensing unit is provided to sense whether the vibration unit vibrates with a predetermined strength in response to the strength of the AC or AC voltage applied to the vibration generating unit.

8. The microphone of claim 7, wherein the vibration generating unit includes a third electrode disposed in the upper direction in the depressed groove and disposed to be separated from the vibration sensing unit disposed in the case, a fourth electrode disposed to be separated from the vibration sensing unit disposed on the vibration unit while facing the third electrode on the vibration unit, and a power applying unit connected to the third electrode and the fourth electrode to selectively apply the AC or AC voltage, and the vibration generating unit is provided to vibrate the vibration unit through electrostatic force applied between the third electrode and the fourth electrode.

9. A microphone comprising:

a vibration member having a plate shape and formed so as to have elasticity and cause bending due to sound waves;

a case having a depressed groove, which forms an air layer between the depressed groove and the vibration member since the vibration member is stacked on an upper part thereof, and coupled to the upper part of the depressed groove such that the vibration member is vibrated by sound waves; and a vibration detection unit provided on the vibration unit and the case and measuring the vibration of the vibration member vibrating by sound waves on the case;

wherein the vibration member includes hinge parts formed to protrude in both directions in the horizontal direction of the vibration member and configured to serve as a rotary axis when the vibration member vibrates by the sound waves, and wherein the air layer is formed between the vibration member and the depressed groove by the hinge parts.

10. The microphone of claim 9, wherein a plurality of vibration members is provided on the case, a plurality of depressed grooves is formed as many as the vibration members, and the plurality of vibration members is disposed not to be parallel to each other to be independently vibrated by sound waves generated from a sound source and the vibration sensing units are provided in the vibration members as many as the vibration members to measure the vibrations of the respective vibration member which independently vibrate.

11. The microphone of claim 10, wherein the vibration members vibrate with the hinge parts provided in the plurality of vibration members as rotary axes, respectively and the vibration members are disposed so that the rotary axes cross each other.

12. The microphone of claim 10, wherein three vibration members are provided on the case and disposed to form a triangular shape by respective ends.

* * * * *